United States Patent [19]

Voth

[11] Patent Number: 4,849,949

[45] Date of Patent: Jul. 18, 1989

[54] TIDE CLOCK DEVICE

[76] Inventor: Allen D. Voth, 652 Gilpin, Denver, Colo. 80218

[21] Appl. No.: 198,103

[22] Filed: May 24, 1988

[51] Int. Cl.[4] ..... G04B 19/26
[52] U.S. Cl. ..... 368/19
[58] Field of Search ..... 318/19

[56] References Cited

U.S. PATENT DOCUMENTS 3,703,804 11/1972 Appelberg ..... 368/19
4,623,259 11/1986 Oberst ..... 368/19

FOREIGN PATENT DOCUMENTS 2944747 8/1981 Fed. Rep. of Germany ..... 368/19
7609072 2/1978 Netherlands ..... 368/19

*Primary Examiner*—Bernard Roskoski

*Attorney, Agent, or Firm*—Timothy J. Martin; J. Preston Oxenham

[57] ABSTRACT

A tide clock device is operative to display tide conditions cycling between low and high tides based on an average cycle time. The device includes a clock drive and a pair of relative rotatable elements, one of which is a display element and the other of which is a masking element. The display element has a shaded area and the masking element sequentially covers and uncovers the shaded area, and the size of the visible portion of the shaded area reflects tide status. Indices and indicators are provided to register the time interval before low tide and before high tide. In one form, the masking element is stationary and has a window opening, and the display element is driven so that an eccentric shaded area is driven past the window opening. In another form, the display element is stationary, and the masking element is an eccentric driven in front of the display element to mask and unmask the shaded area.

27 Claims, 7 Drawing Sheets

TIDE CLOCK DEVICE

FIELD OF THE INVENTION

The present invention is directed generally to clock devices but more specifically to clock devices which indicate or display information correlated to low and high tide conditions. Thus, the present invention is perceived to be an improvement over existing clock devices which have drive mechanisms geared to the cyclical occurrence of low and high tides as dominated by lunar revolution about the Earth and by the relative rotation of the Earth on its own axis with respect to lunar revolution.

BACKGROUND OF THE INVENTION

Since the earliest development of clock mechanisms several hundred years ago, clock devices have increasingly become more sophisticated in their drive mechanisms and in the information displayed. Whereas early clocks simply indicated time, other clocks have been developed which indicate other useful information such as month, day, year, phase of the moon, elapsed time, and the like. Indeed, the variety of information which can be produced by various clock devices is great. Of particular interest, though, for the scope of the present invention, are clock devices which generate tidal information. Such clock devices, when set for a particular geographic location, will indicate the occurrence of low tides, high tides and the time prior to the occurrence of the low and high tide states.

The need for such a tide clock has been recognized in the past but the solution to such need has been accomplished differently than that shown in the present invention. For example, U.S. Pat. No. 3,921,383 issued Nov. 25, 1975 to Leone discloses a tide clock wherein a stationary dial is provided with index markings correlated to low and high tides. The clock drive mechanism drives a clock hand which is read against the dial to indicate low and high tide conditions as well as the time interval before the low and high tide conditions. U.S. Pat. No. 4,014,163 issued Mar. 29, 1977 to Wisser discloses a similar dial having tide indications. Again, a hand is driven by the clock mechanism to register the tide conditions. Another example of prior art is shown in U.S. Pat. No. 3,708,971 issued Jan. 9, 1973 to Wlodyka. Here, an outer dial is provided with indicators of high and low tides, and an indicator dial is indexed with temporal markings which are read against the concentric indicators of the outer dial. U.S. Pat. No. 4,412,749 issued Nov. 1, 1983 to Showalter shows a digital tide indicating clock.

Other examples of tide clocks are shown in the following patents:

| Pat. No. | Issue Date | Inventor |
|---|---|---|
| 569,340 | 13 October 1896 | A. A. Low |
| 2,252,074 | 12 August 1941 | W. H. Gulesian |
| 2,677,928 | 11 May 1954 | W. S. Haynes |
| 3,248,866 | 3 May 1966 | A. F. Spilhaus |
| 3,524,313 | 18 August 1970 | G. W. Wood |
| 3,703,804 | 28 November 1972 | G. T. Appelberg |
| 3,823,544 | 16 July 1974 | A. L. Terrence |
| 3,825,181 | 23 July 1974 | P. M. Banner |
| 3,982,104 | 21 September 1976 | P. M. Banner |
| 4,035,617 | 12 July 1977 | P. M. Banner |

In all of the various tide clock devices, it is well recognized that, for a given location, high and low tides are periodic. Since the gravitational pull of the moon exerts the dominate influence upon bodies of water thus producing tide conditions in such bodies, the geometric location of such body of water, in space, when compared with the location of the Moon, determines tidal conditions. Therefore, the tide cycle is a function of both the rate of rotation of the Earth on its own axis as well as the rate of revolution of the Moon about the Earth. It has well been established that, generally speaking, the tide cycle operates on a period averaging 12 hours and 25 minutes. A further description of the basis of this may be found in U.S. Pat. No. 3,982,104, noted above. As a result of this periodicity, various clock drive mechanisms are available which include, as one of their components, a drive shaft that rotates according to the tidal cycle.

Despite the advances made by the various art tide clocks, there remains a need to provide improved tide clocks which more graphically display tide condition data in an easy to understand format and in an aesthetically pleasing manner.

SUMMARY OF THE INVENTION

It is an object of the present invention to provide a new and useful tide clock which may be driven by existing clock drive mechanism for tide clocks.

A further object of the present invention is to provide a tide clock that graphically displays tide condition data in an aesthetically pleasing manner.

A still further object of the present invention is to provide a tide clock having a display that is more readily understandable to the average observer.

Yet another object of present invention is to provide a tide clock that indicates the time interval to occur between low tides and high tides and which indicates whether tides are ebbing or flowing.

According to the present invention, then, a tide clock device is provided and may be constructed as an independent unit or incorporated into an existing time clock. To this end, the broad form of the present invention is a tide clock having a housing which receives a clock drive mechanism that is geared to rotate a shaft corresponding to the tidal cycle. A display element and a masking element are mounted in the housing for relative rotation with respect to one another. The display element has an outer surface provided with a shaded area, the clock drive mechanism relatively rotates the display element and the masking element on an axis of rotation whereby the masking element sequentially covers and uncovers the shaded area to indicate tidal conditions ranging from a low tide condition to a high tide condition. Preferably, index markings are provided to indicate a variable first time interval that remains until the next sequential low tide condition and to indicate a variable second time interval that remains until the next sequential high tide condition.

In one general embodiment of the present invention, the masking element is a stationary dial which is provided with a window opening defining a view area. The display element is then located behind the masking element and is rotatable whereby the shaded area is advanced past the window opening so that a portion of the shaded area is revealed in the view area. The shaded area is in the form of an eccentric so that the visible portion thereof increases in size from a low tide condition to a high tide condition and decreases in size from a high tide condition to the low tide condition. Flow and ebb indicators may be provided to indicate a flow condition and an ebb condition.

In one form of this general embodiment, low tide index markings are correlated to time and are positioned on one side of the window opening while high tide index markings, also correlated to time, are positioned on an opposite side of the window opening. The shaded area has a boundary line that, as it is advanced past the view area, registers with the low tide index markings to display the first variable time interval and registers with the high tide index markings to display the second variable time interval. A first boundary line portion of the boundary line is color-coded to the low tide index markings and a second boundary line may be color-coded to the high tide index markings. The shaded area is then color-coded with a third color, preferably blue.

In another form of this general embodiment, a low tide indicator is placed on one side of the window opening and a high tide indicator is placed on an opposite side of the window opening. A first set of temporal markings are provided on the display element and are oriented to register with the low tide indicator to display the first variable time interval. A second set of temporal markings are located on the display element and oriented to register with the high tide indicator to display the second variable time interval as the display element is rotated. The shaded region describes an eccentric.

In another embodiment of the present invention, the display element is stationary and the masking element is in the form of a rotatable eccentric located in front of the display element. Thus, the masking element is advanced past the shaded area so that the shaded area is blocked from view in a low tide condition and is increasingly revealed as the mask element is rotated. When the mask element reveals a maximum visible portion of the shaded area, the high tide condition is indicated. Likewise, the shaded area is decreasingly revealed as the masking element moves from the high tide condition toward the low tide condition. The masking element may thus carry an indicator which will register with temporal markings on the display element which are oriented to display the first and second time intervals as the masking element is rotated.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a tide clock device operative to display low tide and high tide conditions as well as to indicate the time interval to elapse prior to the occurrence of the low and high tide conditions. It should be appreciated from the following description that the tide clock device according to the present invention may be constructed as an independent unit or, in the alternative, may be constructed in conjunction with traditional timing devices such as are well known in the art. It should also be well understood that the present invention is described with respect to several different embodiments which in general employ a pair of relatively rotatable elements, one element defining a masking element and the other defining a display element, which reveal a display indicative of tide conditions. It should naturally be appreciated that different forms of this display and masking arrangement may be accomplished without departing from the scope of the present invention.

Figure 1:
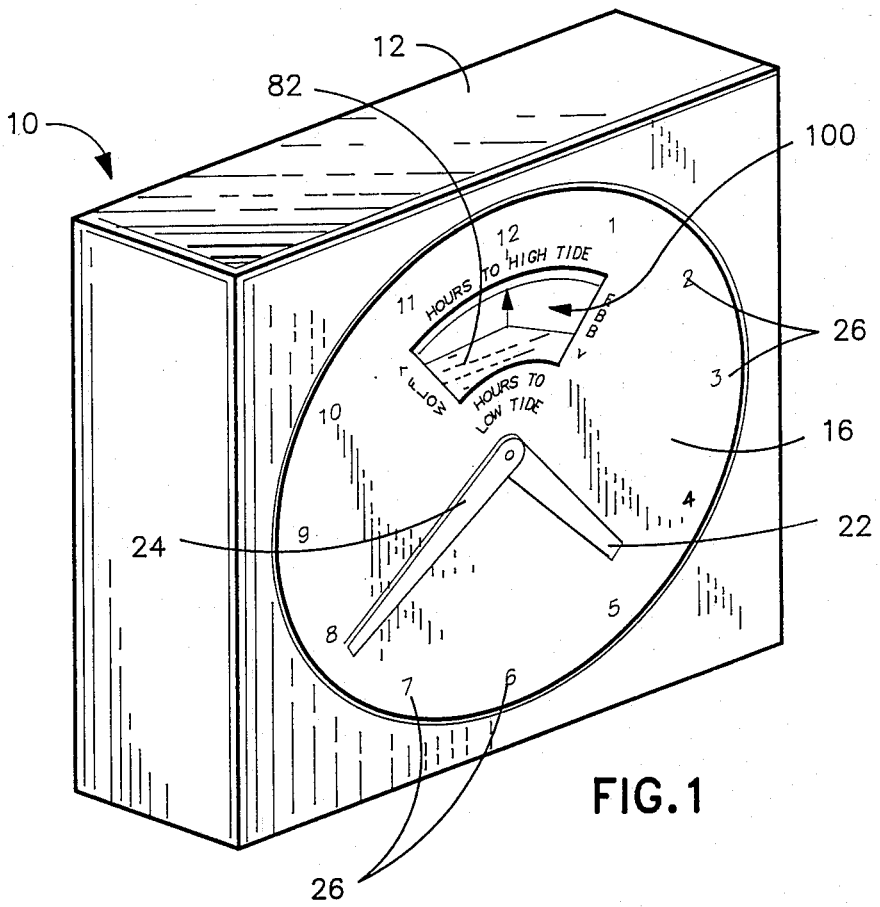
FIG. 1 is a perspective view of a tide clock device according to the preferred embodiment of the present invention.
Figure 2:
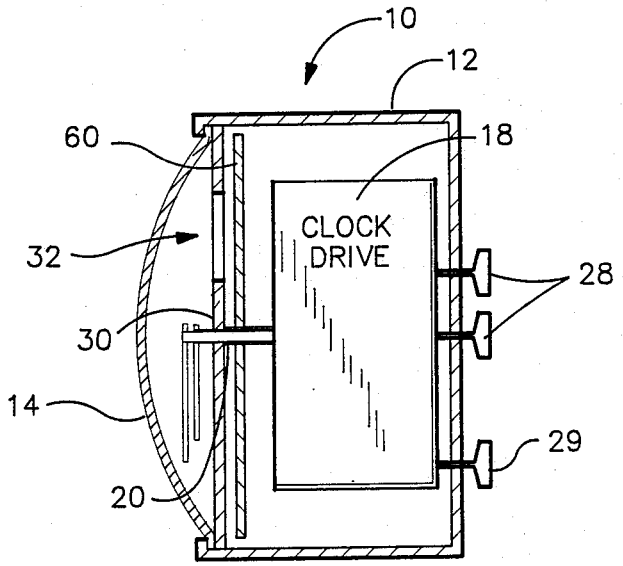
FIG. 2 is a cross-section of the tide clock device shown in FIG. 1.

Turning then to the preferred embodiment, it may be seen in FIGS. 1 and 2 that tide clock device 10 according to the present invention includes a housing 12 which has an open front that is protected by means of a protective glass 14. A dial 16 is located at the front of housing 12, and a clock drive 18 is mounted in the interior of housing 12 in order to drive the respective time indicating elements. To this end, clock drive 18 includes a shaft drive set 20, of a type known in the art, which includes multiply rotating spindles that are secured to the various indicating means, such as hour hand 22 and minute hand 24. Hour hand 22 and minute hand 24 register with indicia 26 in order to indicate time of day.

In order to generate tide condition data, tide clock device 10 includes a disc-shaped masking element 30 which is mounted in housing 12 and a rotating disc-shaped display element 60 which is rotatably mounted on one shaft of shaft drive set 20, as is shown in FIG. 2. It should be appreciated that clock drive 18 is geares so as to cyclically drive hour hand 22 and minute hand 24 according to standard twelve hour cycle while at the same time being geared so that display element 60 is cyclically driven according to the tide cycle which averages 12 hours and 25 minutes. Clock drive 18 is provided with time set screws 28 to adjust the reading of clock device 10, and a adjusting screw 29 is provided to be engaged to independently adjust the position of display element 60 allowing tide conditions to be selectively adjusted, as required to compensate for different geographical locations as well as in the event that clock drive 18 temporarily malfunctions due to loss of power or otherwise. Since the nature of clock drive 18 and adjustment screws 28 and 29 are known in the art, no further description of these elements of the present invention are made in this disclosure.

Figure 3:
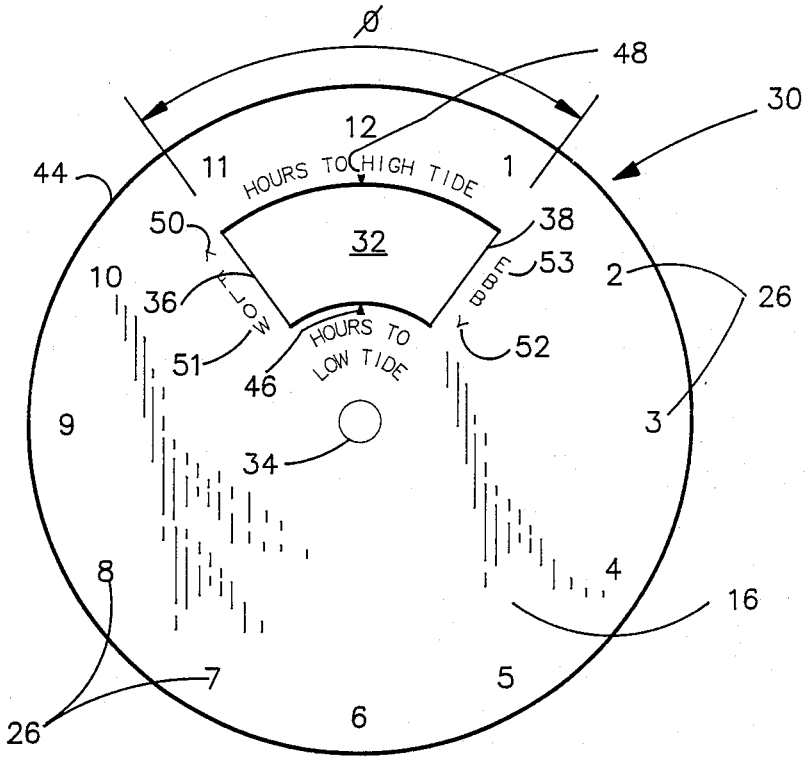
FIG. 3 is a front plan view of the masking element used for the device shown in FIGS. 1 and 2.

As is best shown in FIG. 3, masking element 30 forms a front face for clock device 10 and carries indicia 26 which thus defines dial 16. Indicia 26 correspond to the hours of the day for registration with hands 22 and 24, as described above. Masking element 30 includes a window opening 32 radially spaced from the center 34 of disc element 30; window opening 32 is preferably located at the "upper" part of masking element 30 between center 34 and the numeral "12" of dial 16. Window opening 32 has opposite side edges 36 and 38 which are formed radially of center 34 and are oriented at an angle $\phi$ which, in the preferred embodiment of the present invention, is approximately 70°. Window opening 32 includes an arcuate side edge 40 and a second arcuate side edge 42 which are formed as arcs of circles that are concentric with one another and with outer edge 44 of element 30. A low tide indicator 46 is arrow-shaped in configuration and is centrally located on side edge 40. Similarly, a high tide indicator 48 is arrow-shaped in configuration and is centrally located on arcuate side edge 42. Low tide indicator 46 indicates a low tide condition and the hours to elapse before a low tide condition occurs; high tide indicator 46 indicates the occurrence of high tide and also the amount of time to elapse before the high tide condition occurs. A reference arrow 50 is correlated by the word "flow" located at location 51 as a key to the flow indicators as described below. Similarly, reference arrow 52 is labeled with the word "ebb" as a key to the ebb indicator, also as described below at location 53.

Figure 4:
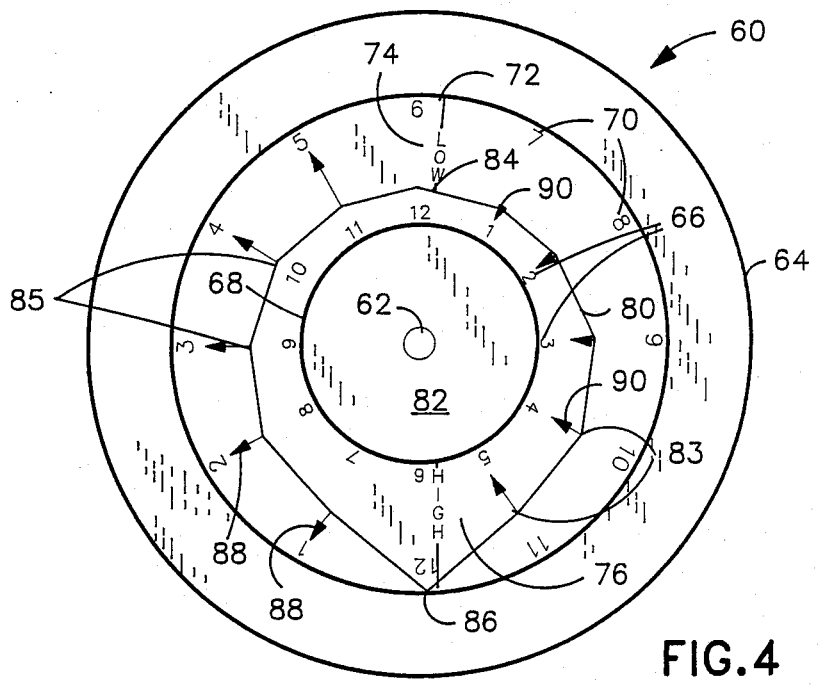
FIG. 4 is a front plan view of the display element used for the clock device shown in FIGS. 1 and 2.

Display element 60 is best shown in FIG. 4. In the preferred embodiment, display element 60 is formed as a disc-shaped element having a center 62 and an outer circular edge 64. It should be appreciated that center 62 of display element 60 is constructed to be coaxial with center 34 of masking element 30. A first set of temporal markings 66 are located on an indexed circle 68 that circumscribes center 62. As described below, first temporal markings 66 will indicate a first time interval corresponding to the amount of time to elapse prior to the occurrence of low tide. A second set of temporal markings 70 are indexed on a circle 72 which circumscribes both center 62 and circle 68. Second temporal markings 70, as described below, are operative to indicate the amount of time to elapse before the occurrence of high tide. First temporal markings 66 are enumerated integrally from 1 through 11, inclusively, and, likewise, second temporal markings 70 are enumerated with the integral numbers 1 through 11, inclusive. Furthermore, as can be seen in FIG. 4, first and second temporal markings 66, 70 are staggered with respect to one another to accommodate the 12 hour and 25 minute tide cycle. It should be understood that each of circles 68 and 72 are indexed for 12 hours and 25 minutes corresponding to the tide cycle, and that display element 60 is rotatably driven in a clockwise direction with respect to masking element 30 by clock drive 18 and completes one rotation every 12 hours and 25 minutes, thus defining one tide cycle. The low tide condition is indexed at 74 and the high tide condition is indexed at 76, as is shown in FIG. 4.

A boundary line 80 describes a polygonal shaded eccentric area 82 around center 62 with boundary line 80 being located between circles 68 and 72. Boundary line 80 accordingly has a first set of vertices having members such as shown at 83 which are indexed to first temporal markings 66 and a second set of vertices having members such as shown at 85 which are indexed to second temporal markings 70. The interior of eccentric area 82, as bounded by line 80, is preferably shaded blue to represent water. Eccentric area 82 has a minima at location 84, which corresponds to a low tide condition, and a maxima at 86 which corresponds to a high tide condition. Flow indicating arrows 88 extend from boundary line 80 and point outwardly at most of vertices 85 indicating the hourly intervals corresponding to the time when tides are increasing from the low tide toward the high tide, thus indicating that the tide is flowing. Likewise, ebb indicating arrows 90 extend radially inwardly from boundary line 80 at most of vertices 83 and point inwardly toward circle 68 to indicate that tide is flowing. With reference again to FIG. 1, it may now be appreciated that window opening 32 forms a view area 100 through which a portion of display element 60 is revealed to display tide conditions.

Figure 5A:
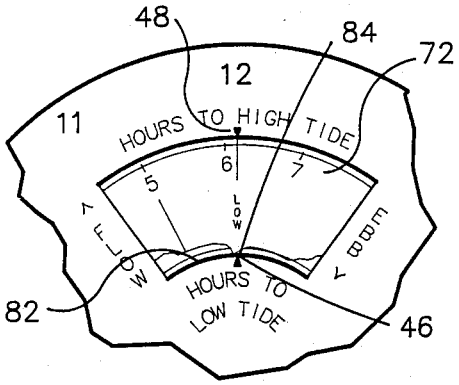
FIGS. 5*a*–5*d* showing cut-away portions of the combination of the masking element and the display element sequentially moving from a low tide condition through a high tide condition back toward a low tide condition as a full tide cycle.
Figure 5B:
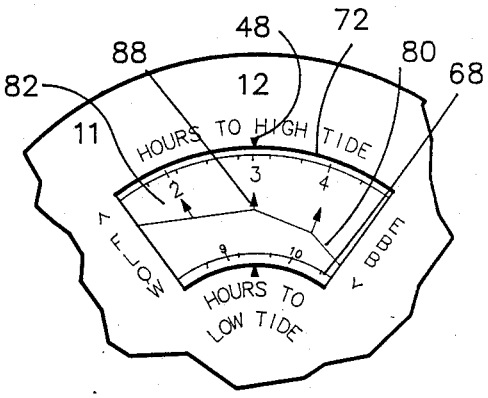

With reference to FIGS. 5*a*–5*d*, the tide cycle as displayed by masking element 30 and display element 60 can be more fully appreciated. In FIG. 5*a*, it may be seen that a low tide condition is present such that location 84 registers with low tide indicator 46. High tide indicator 48 indicates that slightly over 6 hours remain until high tide, by its registration with the indices of circle 72. After approximately three hours, twelve and one-half minutes, display element 60 is driven to the position shown in FIG. 5*b*. Here, indicator 48 registers with the temporal markings on circle 72 which indicates that approximately three hours remain until the occurrence of high tide. The fact that tide is flowing is shown by flow indicator 88 extending radially outwardly from boundary line 80 of eccentric 82. Furthermore, it may be seen that the shaded eccentric area 82 has a visible portion revealed in view area 100 that is greater than the portion of eccentric area 82 visible in FIG. 5*a*. Further, with respect to FIG. 5*b*, it may be seen that low tide indicator 46 registers with the temporal markings on circle 68 to show that slightly over nine hours remain until low tide is reached.

Figure 5C:
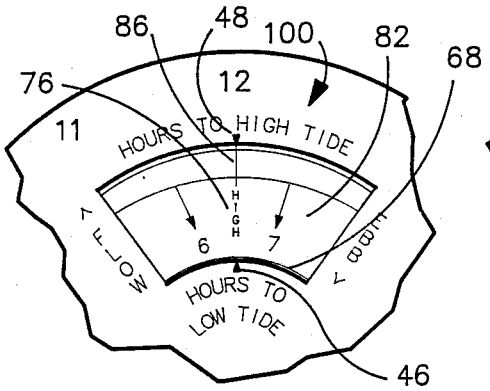
Figure 5D:
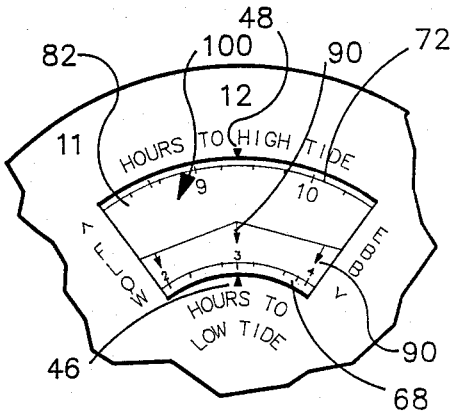

After the passage of approximately three hours time, FIG. 5*c* shows a high tide condition wherein the high tide indicator at 76 registers with high tide indicator 48 and maxima 86 of eccentric shaded area 82 also registers with high tide indicator 48. Low tide indicator 46 registers with the temporal markings on circle 68 to indicate that low tide will occur in slightly over six hours. After the passage of three hours, twelve and one-half minutes, display element 60 is rotated to the position shown in FIG. 5*d*. Here, low tide indicator 46 registers with the temporal markings of circle 68 to indicate that three hours remain until low tide whereas high tide indicator 48 registers with the temporal markings on circle 72 to indicate that nine hours, twelve and one-half minutes remain until the next high tide. Ebb indictors 90 show that the tide is ebbing, and it should be appreciated that the visible shaded area of shaded eccentric 82 in view area 100 is decreasing from that shown in FIG. 5*c*. After the passage of three more hours, display element 60 moves back to the position shown in FIG. 5*a*, and one full tide cycle is completed.

From the foregoing, it may now be understood that display element 60 has an outer surface that is provided with a shaded area that forms an eccentric cam. This eccentric cam is rotatably driven with respect to a masking element so that the masking element sequentially covers and uncovers the shaded area to indicate the tidal conditions ranging from a low tide condition to a high tide condition. Preferably, the visible portion of the shaded area increases in size from the low tide condition to the high tide condition, and decreases in size from the high tide condition to the low tide condition through a cycle.

If desired, alternate means of indicating that the tide is flowing or ebbing may be utilized with respect to the preferred embodiment shown in FIGS. 1–5. For example, with reference to FIG. 4, it would be possible to color-code boundary line 80 along that portion that extends clockwise from location 84 to location 86, such as with a red line, to indicate that the tide was flowing and to color-code that portion of line 80 from location 86 clockwise to location 84, such as with a green line, to indicate that the tide was ebbing. Other flow and ebb indicating means, such as arrows contained in the shaded area of eccentric 82 are well within the scope of the present invention.

Figure 6:
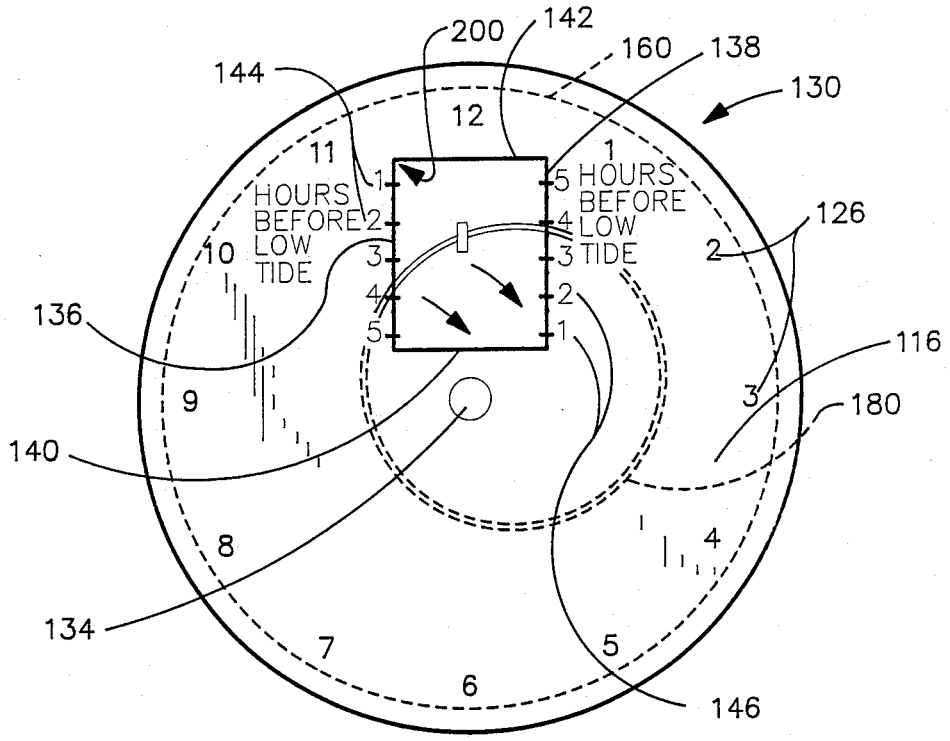
FIG. 6 is a front plan view of an alternate embodiment of the masking element and display element according to a first alternate embodiment of the present invention.
Figure 7:
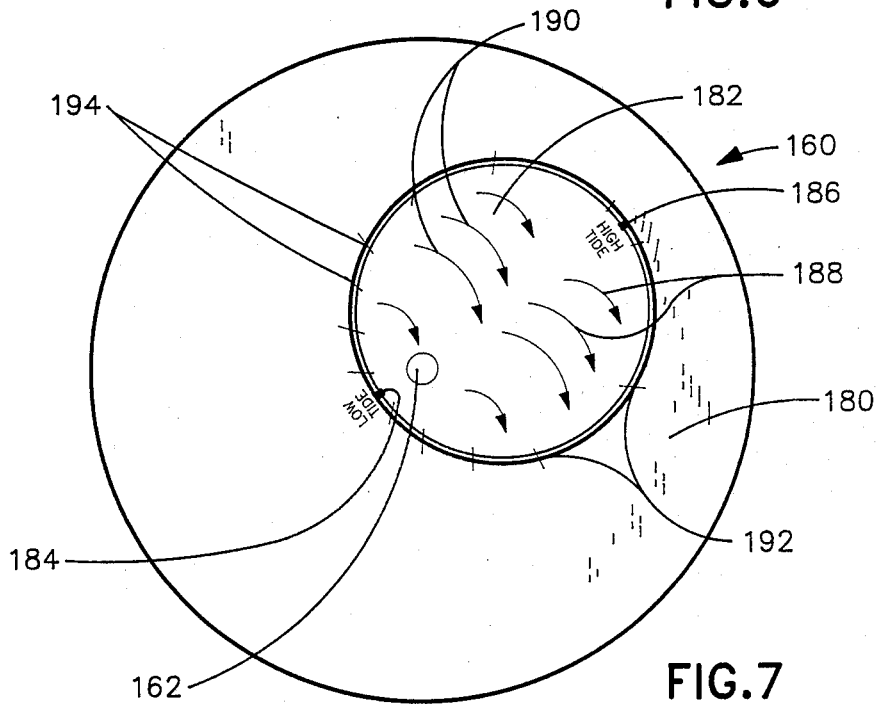
FIG. 7 is a front plan view of the display element shown in FIG. 6.

A first alternate embodiment of the present invention is shown in FIGS. 6–8. As is shown in these figures, a stationaly masking element 130 forms a dial 116 for a tide clock device. Dial 116 is provided with time indicia which indicate elapsed time by means of the standard hour and minute hands of the clock. A display element 160 (shown in phantom in FIG. 6) is mounted rearwardly of masking element 130 and is located on a rotational axis passing through center 134 of masking element 130. Masking element 130 is provided with a rectangular window opening 132 which defines a view area 200 permitting observation of display element 160 therethrough. Window opening 132 has a pair of lateral side edges 136 and 138, a bottom edge 140 and a top edge 142. Side edge 136 is provided with indicia 144 in the form of numerals indicating hours before high tide, and side edge 138 is provided with indicia 146 in the form of numerals indicating hours before low tide.

Display element 160 is best shown in FIG. 7 and includes a center 162 and a shaded eccentric area 162 which is surrounded by a boundary line 180. Preferably, boundary line 180 is separated into a first color-coded portion which extends clockwise from location 184 to location 186, and a second color-coded portion which extends clockwise from location 186 back to location 184. Preferably, the first color-coded portion is green, and the second color-coded portion is red. Furthermore, boundary line 180 is provided with a plurality of marks 194 which extend radially from center 132. A plurality of flow indicators 188 are located as curved arrows within eccentric shaded area 182, and a plurality of curved ebb indicating arrows 190 are also located within area 182. Eccentric shaded area 182 preferably is colored blue.

Figure 8A:
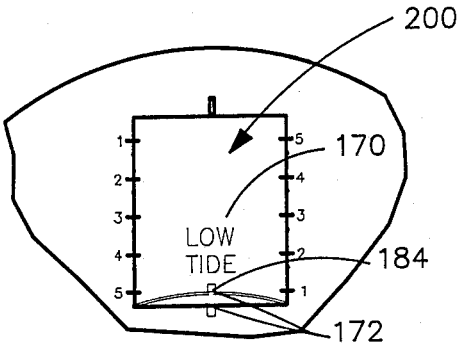
FIG. 8*a*–8d show a front plan view of a portion of the tide clock according to the alternate embodiment of FIGS. 6 and 7, cycling from a low tide through a high tide condition for a tide cycle.
Figure 8B:
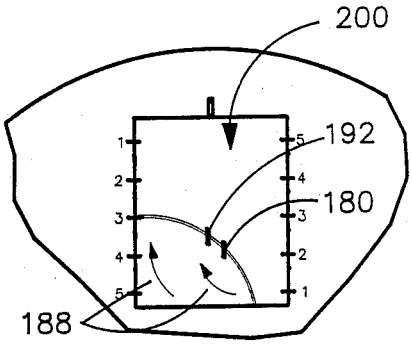
Figure 8C:
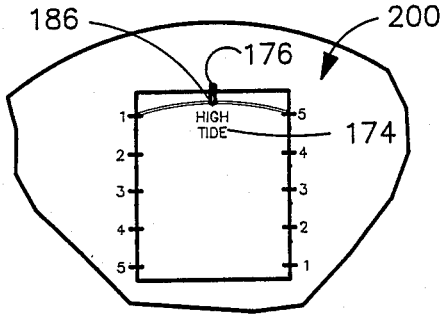
Figure 8D:
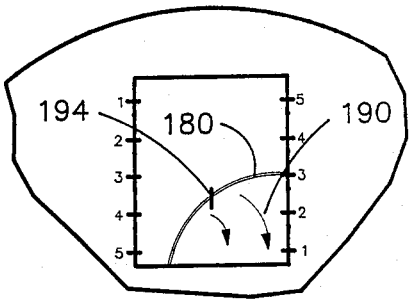

The operation of the device shown in FIGS. 6 and 7 may be best appreciated with reference to FIGS. 8*a*–8*d*. In FIG. 8*a*, a low tide condition exists as is indicated at location 170 by low tide indicator 172 which registers with location 184. Display element 160 is rotatably driven clockwise with respect to stationary masking element 130 so that, after thre hours, twelve and one-half minutes, display element 60 moves to the position in FIG. 8*b*. Here, flow indicator arrows 188 indicate that the tide is flowing and the registration of boundary line 180 with the indicia 194 indicates that three hours remain before high tide. After the lapse of another three hours, high tide is indicated at location 174 by the registration of location 186 with high tide indicator 176. After the passage of another three hours, twelve and one-half minutes, display element 160 is moved through to the position shown in FIG. 8*d*. Here, ebb indicating arrows 190 show that the tide is ebbing and boundary line 180 indicates that approximately three hours remain before low tide. After another three hours, the cycle is completed and the display returns to the position shown in FIG. 8*a*.

From the foregoing, it should be appreciated that the amount of the shaded area 182 visible in view area 200 increases from low tide to high tide and then decreases back to low tide. This corresponds to the rising of water in a high tide condition and to the lessening of water level in a low tide condition. Furthermore, it should be understood that, by having boundary line 180 separated into two color-coded portions, indicia 194 may be color-coded red to correspond to the red portion of line 180 that extends clockwise from location 186 to 184 (also red) and that indicia 146 may be color-coded (green) correspondingly to that portion of line 180 that extends clockwise from location 184 to location 186.

Figure 9:
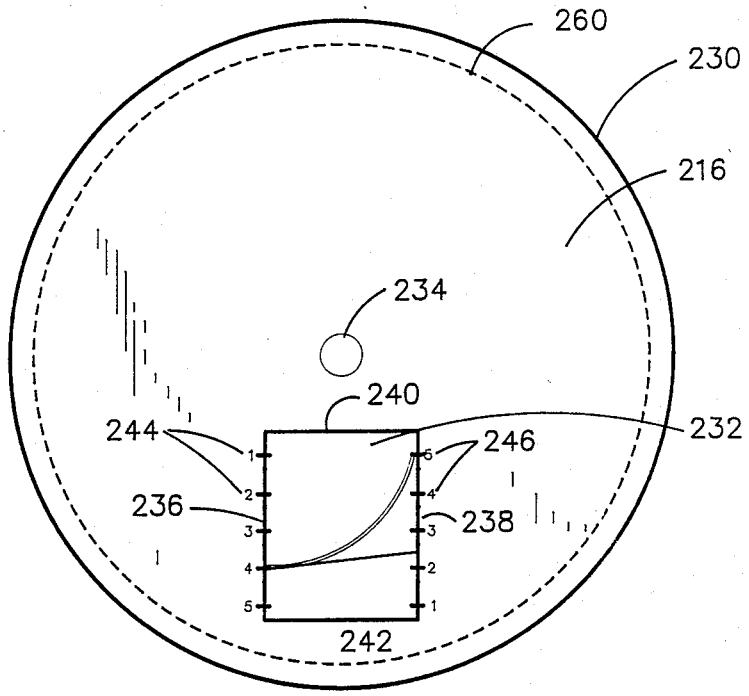
FIG. 9 is a front plan view of a second alternate embodiment of the masking element and display element according to the present invention.
Figure 10:
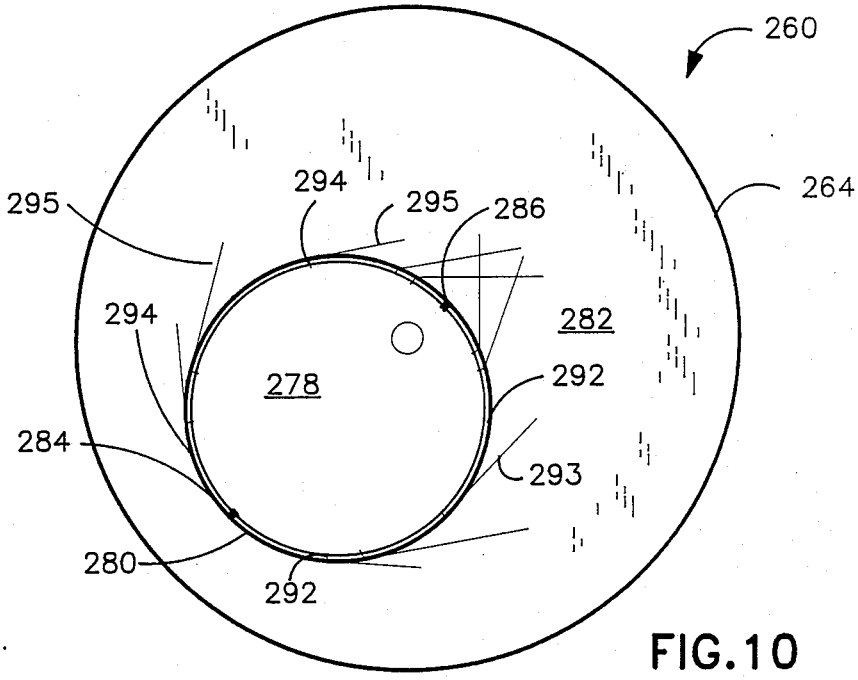
FIG. 10 is a front plan view of the display element shown in FIG. 9.

A second alternate embodiment of the present invention is shown in FIGS. 9-11(a-d). As is shown in FIG. 9, a masking element 230 forms a dial 216 for a clock device similar to that shown in FIG. 10. Masking element 230 includes a window opening 232 which is spaced from center 234 that defines an axis of rotation for display element 260. As may be seen in the embodiment shown in FIG. 9, window 232 is located in the lower part of dial 216 between center 234 and the time numeral "6" rather than in the upper part of the dial as shown in FIGS. 3 and 6. Window opening 232 has a pair of lateral side edges 236 and 238, a top side edge 240 and a bottom side edge 242. Side edge 236 is provided with index markings and indicia 244 in the form of numerals representing the hours before high tide. Likewise, side edge 238 is provided with numerical indicia indicating the hours before low tide.

Display element 260 is best shown in FIG. 10 and includes an eccentric region 278 which is bounded by a boundary line 280. Display element 260 has an outer edge 264 and is shaded in the region between boundary line 280 and outer edge 264. Thus, it may be appreciated that eccentric area 278 is not shaded, which is exactly opposite to the manner of shading as described with respect to FIG. 7. Boundary line 280 is preferably color-coded so that it is colored green in that portion which extends clockwise from location 284 to location 286. The portion of line 280 that extends from location 286 clockwise to location 284 is then color-coded red. A plurality of markings 292 are located along the portion of line 280 which extends between location 286 clockwise to location 284 and are represented as the intersection of line 280 with a plurality of tangential lines, such as lines 293. Similarly, a plurality of markings 294 are formed as intersections of tangential lines 295 with the portion of line 280 which extends clockwise from location 284 to location 286. It should be appreciated, thus, that eccentric region 278 is not shaded but that shaded eccentric region 282 located between boundary line 280 and edge 264 complements region 278.

The operation of the embodiment shown in FIGS. 9 and 10 is best appreciated from a review of FIGS.

Figure 11A:
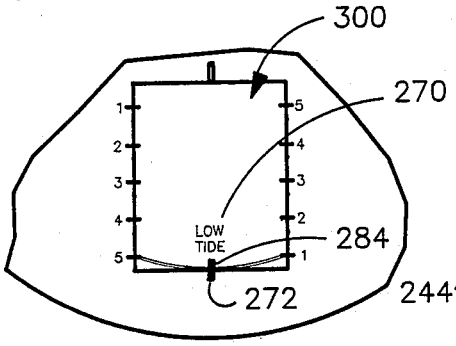
FIG. 11*a*–11*d* show the view region of the alternate embodiment of the present invention shown in FIGS. 9 and 10 cycling from a low tide condition through a high tide condition for a tide cycle.
Figure 11B:
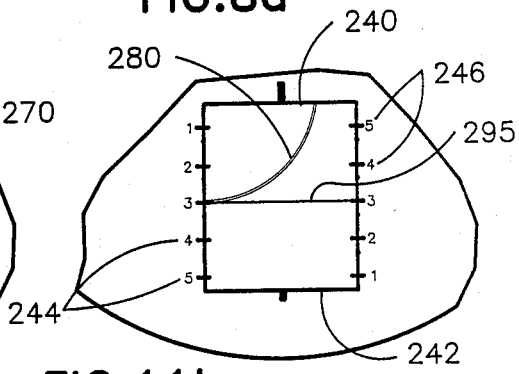
Figure 11C:
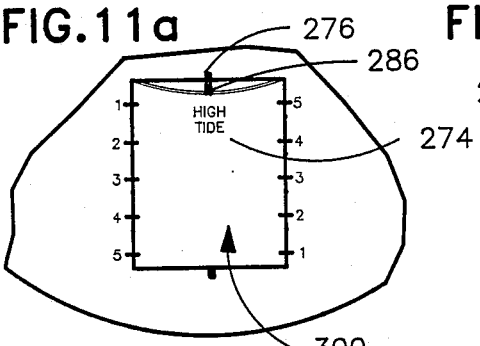
Figure 11D:
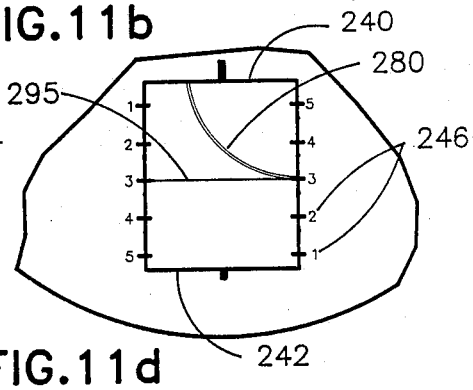

11*a*–11*d*. Here, FIG. 11*a* shows a low tide display wherein location 284 aligns with low tide indicator 272. This low tide condition is indicated at 270, and view area 300 is substantially clear of any shaded material. After approximately three hours, twelve and one-half minutes, display element 260 rotates to the position shown in FIG. 11*b* wherein lines 280 registers against high tide indicia 244 to indicate that approximately three hours remain before high tide. Line 295 is parallel with edges 240 and 242. After approximately another three hours, high tide is indicated at 274 by means of the registration of high tide indicator 276 with location 286. In this state, view area 300 is completely filled with a shaded portion of eccentric region 282. After approximately another three hours, twelve and one-half minutes, display element 260 is further rotated, as is shown in FIG. 11c, so that line 280 registers with indicia 246 to indicate that approximately three hours remain before low tide. Line 295 is now parallel with top and bottom edges 240 and 242. As before, line 280 and indicia 244 and 246 may be color-coded to correspond with one another.

Yet another embodiment of the present invention is shown in FIGS. 12*a*–12*d*. This embodiment differs from the embodiment shown in FIGS. 1–11(a-d) in that the display element is held stationery while the masking element is rotated clockwise with respect thereto. As may be seen in FIG. 12*a*, display element 360 forms a dial 316 for a tide clock device and includes time indicia 326 so that a pair of clock hands (not shown) may denote the time of day. Display element 360 has a center 362 and a circle 376 is formed concentric with outer edge 364 of disc-shaped element 360. Circle 376 carries a first set of temporal markings, such as at 366, which indicate hours before low tide, and a second set of temporal markings, such as at 370, which indicate hours before high tide. Display element 360 carries a shaded region 382, shown in phantom in FIG. 12*a*. Masking element 330 is rotatably mounted with respect to display element 360 and is in the form of an eccentric cam which rotates about an axis located at center 362 of display element 360. Masking element 330 is sized so as to progressively uncover and cover shaded area 382, as is shown in FIGS. 12*a*–12*d*, and carries an index pointer 384 which is positioned to register with temporal markings 366 and 370 along circle 376.

Figure 12A:
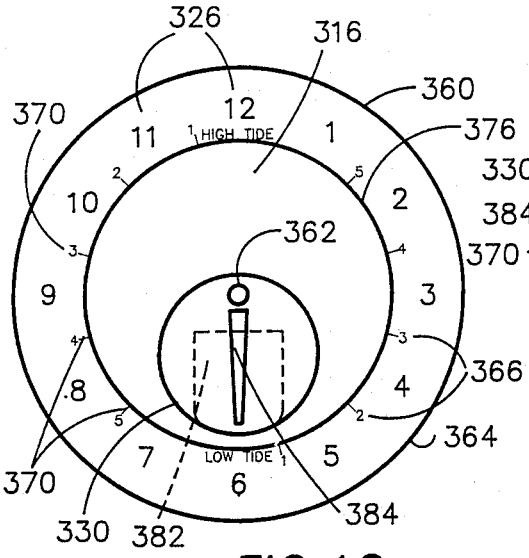
FIGS. 12*a*–12*d* shows a third embodiment of the present invention having a movable element and shown cycling between low and high tide conditions.
Figure 12B:
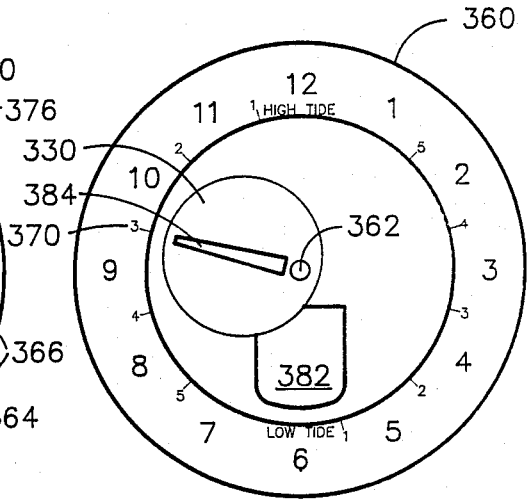
Figure 12C:
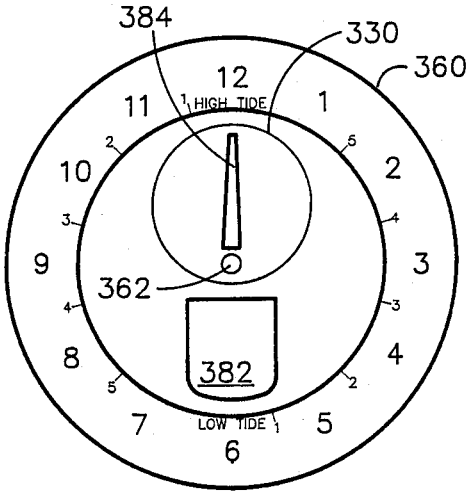
Figure 12D:
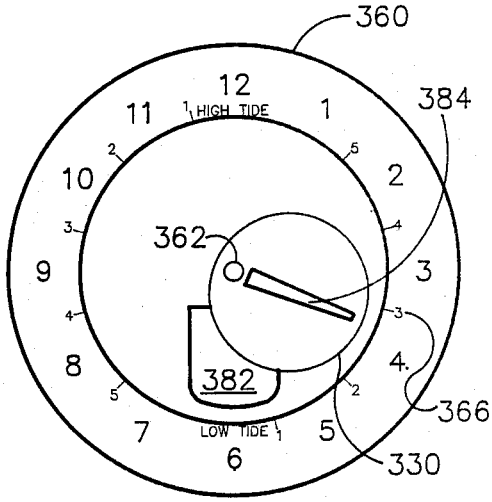

As may now be fully appreciated from reviewing FIGS. 12*a*–12*d*, a complete tide cycle is shown starting in a low tide condition shown in FIG. 12*a*. Here, mask element 330 completely covers shaded area 382 with index pointer 384 indicating a low tide condition. After the passage of three hours twelve and one-half minutes, masking element 330 moves to the position shown in FIG. 12*b*. Here, it may be seen that index pointer 384 indicates that three hours remain until high tide as is shown by temporal marking 370. A portion of shaded region 382 on display element 360 is now uncovered. After the passage of another three hours, masking element 330 rotates to the position shown in FIG. 12*c* wherein index pointer 384 points to a high tide state, and shaded region 382 is completely uncovered. Again, after the passage of three hours, twelve and one-half minutes, masking element 330 moves to the position shown in FIG. 12*d*. Index pointer 384 registers with temporal marking 366 to indicate that three hours remain until low tide. During this movement, a portion of shaded area 382 becomes covered by masking element 330. After the passage of three hours, masking element 330 again moves into the position shown in FIG. 12*a*.

It may be seen that, during progression from FIGS. 12*a* to 12*d*, masking element 330 progressively uncovers and recovers shaded area 382. The portion of shaded area 382 which may be seen by an observer increases from a low tide state to the high tide state and decreases from the high tide state to the low tide state. Conveniently, shaded area 382 may be colored blue to indicate water so that more "water" is shown as the tide clock moves from low tide to high tide and less is shown as the tide clock moves from high tide to low tide. Masking element 330 is driven by the standard average tide cycle clock drive, as discussed above, and it may be appreciated that masking element 330 should be positioned between any hour and minute hands and display element 360 so as not to interfere with the telling of time at time indicia 326.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A tide clock device mounted in a housing and operative to display tidal conditions, comprising:

a display element having an outer surface provided with a shaded area;

a masking element mounted for relative rotation with respect to said display element about an axis of rotation;

a clock drive means for rotating one of said display element and said masking element with respect to the other on an axis of rotation whereby said masking element sequentially covers and uncovers portions of the shaded area to indicate tidal conditions ranging from a low tide condition to a high tide condition; and cooperative index means associated with said masking element and said display element for indicating a variable first time interval in hours and portions thereof until the low tide condition will occur and for indicating a variable second time interval in hours and portions thereof until the high tide condition will occur.

2. A tide clock device according to claim 1 wherein said masking element is stationary with respect to said housing and has a window opening formed therein which defines a view area, said display element being located behind said masking element rotatable with respect to said masking element whereby said shaded area is advanced past said window opening so that a visible poriton of the shaded area is revealed in the view area, said visible portion increasing in size from said low tide condition to said high tide condition and decreasing in size from said high tide condition to said low tide condition.

3. A tide clock device according to claim 3 including flow and ebb indicator means for indicating flowing and ebbing tide conditions.

4. A tide clock device according to claim 3 wherein said index means includes low tide index markings correlated to time on one side of said window opening and high tide index markings correlated to time on an opposite side of said window opening from said one side, said shaded area having a boundary line that registers with said low tide index marking to display said first variable time interval and with said high tide index markings to display said second variable time interval.

5. A tide clock device according to claim 4 wherein said boundary line defines a perimeter for an eccentric area.

6. A tide clock device according to claim 5 wherein said boundary line has a first boundary line poriton around one-half of said eccentric which is color-coded with a first color and a second boundary line portion around the other one-half of said eccentric which is color-coded with a second color.

7. A tide clock device according to claim 6 wherein said low tide index markings are color-coded said first color whereby said first boundary portion registers therewith to indicate said first time interval and wherein said high tide index markings are color-coded with said second color whereby said second boundary portion registers therewith to indicate said second time interval.

8. A tide clock device according to claim 6 wherein said shaded area is color-coded with a third color different from said first and second colors.

9. A tide clock device according to claim 5 wherein said shaded area is the eccentric area enclosed by said boundary line.

10. A tide clock device according to claim 5 wherein said shaded area is a surface area of said display element outside of said eccentric area.

11. A tide clock device according to claim 3 wherein said index means includes a low tide indicator on one side of said window opening and a high tide indicator on an opposite side of said window opening from said one side, a first set of temporal markings on said display element and oriented to register with said low tide indicator to display said first variable time interval as said display element is rotated and a second set of temporal markings on said display element and oriented to register with said high tide indicator to display said second variable time interval as said display element is rotated.

12. A tide clock device according to claim 11 wherein said shaded area is defined by an eccentric area rotating on said axis of rotation and bounded by a boundary line.

13. A tide clock device according to claim 12 wherein said boundary line is a polygon having a first set of vertices correlated to the hours corresponding to the first time interval and a second set of vertices correlated to the hours corresponding to the second time interval.

14. A tide clock device according to claim 13 wherein said first set of temporal markings are located on a first circle and said second set of temporal markings are located on a second circle concentric with said first circle.

15. A tide clock device according to claim 14 wherein said boundary line is located between said first and second circles and wherein some members of said first set of vertices are connected to said first circle by a first set of radial lines and wherein some members of said second set of vertices are connected to said second circle by a second set of radial lines.

16. A tide clock device according to claim 11 wherein said window opening is arcuate in shape and has lateral side edges that extend radially of said axis of rotation.

17. A tide clock device according to claim 16 wherein said lateral side edges are oriented approximately 70° apart.

18. A tide clock device according to claim 11 including flow and ebb indicator means for indicating flowing and ebbing tide conditions.

19. A tide clock device according to claim 1 wherein said display element is stationary with respect to said housing, said masking element formed as a rotatable eccentric located in front of said display element whereby said masking element is advanced past said shaded area so that said shaded area is blocked from view in said low tide condition and is increasingly revealed from said low tide condition to a maximum visible portion in said high tide condition and is decreasingly revealed as the masking element moves from said high tide condition toward said low tide condition.

20. A clock device according to claim 19 including cooperative index means associated with said masking element and said display element for indicating a variable first time interval until the low tide condition will occur and for indicating a variable second time interval until the high tide condition will occur.

21. A tide clock device according to claim 20 wherein said index means includes an indicator on said masking element and temporal markings on said display element oriented to register with said indicator to display said first and second variable time intervals as said masking element is rotated.

22. A tide clock device mountable in a housing and operative to display tidal conditions, comprising:

a masking element mounted in said housing and stationery with respect thereto, said masking element forming a dial for said tide clock device and having a window opening formed therein to define a view area;

a disc-shaped display element mounted in said housing behind said masking element and rotatable about an axis of rotation with respect to said masking element, said display element having an outer surface facing said masking element provided with a shaded area bordered by a boundary line, said boundary line in the shape of an eccentric area rotatable about said axis of rotation, said eccentric region sized to move into and out of said view area as said display element is rotated;

a clock drive means for rotating said display element with respect to said masking element on said axis of rotation whereby the movement of said eccentric into and out of said view area corresponds to low tide and high tide conditions; and cooperative index means adjacent said window opening and on said display element for indicating a variable first time interval in hours and portions thereof until the low tide condition will occur and for indicating a variable second time interval in hours and portions thereof until the high tide condition will occur.

23. A tide clock device according to claim 22 wherein said cooperative index means includes a low tide indicator on one side of said window opening and a high tide indicator on an opposite side of said window opening, a first set of temporal markings on said display element sized and positioned to register with said low tide indicator to display said first variable time interval as said display element is rotated and a second set of temporal markings on said display element sized and positioned to register with said high tide indicator to display said second variable time interval as said display element is rotated.

24. A tide clock device according to claim 22 wherein said cooperative index means includes low tide index markings correlated to time on one side of said window opening and high tide index markings correlated to time on an opposite side of said window opening from said one side, said boundary line operative to register with said low tide index markings to display said first variable time interval and with said high tide index markings to display said second variable time interval.

25. A tide clock device mounted in a housing operative to display tidal conditions, comprising:

a display element mounted in said housing and forming a dial therefore, said display element stationary with respect to said housing and including a shaded area;

a masking element mounted in front of said display element and rotatable with respect thereto;

a clock drive means for rotating said masking element with respect to said display element on an axis of rotation whereby said masking element is advanced past said shaded area whereby said shaded area is sequentially covered and uncovered to indicate tidal conditions ranging from a low tide condition to a high tide condition; and cooperative index means associated with said masking element and said display element for indicating a variable first time interval in hours and portions thereof until the low tide condition will occur and for indicating a variable second time interval in hours and portions thereof until the high tide condition will occur.

26. A tide clock device according to claim 25 wherein said index means includes a first set of temporal markings on said display element correlated to said first time interval and a second set of temporal markings on said display element correlated to said second time interval and an indicator on said masking device positioned to register with said first and second temporal markings.

27. A tide clock device according to claim 26 wherein said masking element is in the form of an eccentric cam.

* * * * *